US005521345A

United States Patent [19]

Wulc

[11] Patent Number: 5,521,345

[45] Date of Patent: May 28, 1996

[54] BACKLIT MEMBRANE KEYPAD

[75] Inventor: Stanley S. Wulc, Rydal, Pa.

[73] Assignee: Tokheim Corporation, Fort Wayne, Ind.

[21] Appl. No.: 316,574

[22] Filed: Sep. 30, 1994

[51] Int. Cl.[6] ..... H01H 9/00

[52] U.S. Cl. ..... 200/317; 200/310

[58] Field of Search ..... 200/317, 310, 200/512, 514, 313, 311, 314, 315, 316, 308, 520

[56] References Cited

U.S. PATENT DOCUMENTS

| | | | |
|---|---|---|---|
| 3,777,222 | 12/1973 | Harris | 317/112 |
| 4,197,439 | 4/1980 | Mecklenburg | 200/159 |
| 4,376,879 | 3/1983 | Nagata | 200/314 |
| 4,414,452 | 11/1983 | Denley | 200/159 |
| 4,493,958 | 1/1985 | Hamilton et al. | 200/314 |
| 4,772,769 | 9/1988 | Shumate | 200/317 |
| 4,811,175 | 3/1989 | Desmet | 362/95 |
| 5,138,119 | 8/1992 | Demeo | 200/5 A |
| 5,149,923 | 9/1992 | Demeo | 200/5 A |
| 5,280,145 | 1/1994 | Mosier et al. | 200/313 |

*Primary Examiner*—David J. Walczak
*Attorney, Agent, or Firm*—Baker & Daniels

[57] ABSTRACT

An illuminated switch assembly which is suitable for incorporation in a membrane keyboard or other switch array is provided. The membrane switch board is provided with a region through which light may pass about the switches. A light source is mounted proximate the switches with a reflector operatively associated therewith. Reflected light from the light source will be passed through the regions about the switch board illuminating an area that is to be pressed to operate the switch.

9 Claims, 3 Drawing Sheets

BACKLIT MEMBRANE KEYPAD

BACKGROUND OF THE INVENTION

The present invention relates generally to keypads and more particular to membrane keypads. A membrane keypad is a relatively thin switch array which is provided with a plastic membrane cover. The use of such a keypad is considered advantageous where space is to be conserved or it is desired to provide a sealed keypad.

In the past, there has been a desire to provide illumination for keypads where electric devices are to be used in low light situations and where contrast is desired to be improved. Additionally, it has been desired to use illumination as an indicator of circuit operation or readiness. The desire for illumination has been partially addressed in some devices by the placement of a signaling lamp adjacent the key site.

Other means of illumination have been offered such as shown in U.S. Pat. No. 4,811,175 which discloses an illuminated switch in which light may pass through a translucent switch cover. The light from the source placed at the interior of the switch passes through the switch and illuminates the area to be pressed. This type of construction, at times, may restrict the placement of the keys or switches.

Other ways for creating illuminated switches are with a dome having a single hole through which the light source may protrude. This type of illumination could be incompatible with some keypads since the light source placement may interfere with the operation of the switch actuator.

Additional needs include low profile, high contrast switch assemblies and a way to create a targeting effect for a particular keypad switch.

The present invention is directed to overcome the aforementioned problems and disadvantages associated with prior art illuminated keypads wherein it is desired to provide a transparent area about the switch illuminated with reflected light.

SUMMARY OF THE INVENTION

The present invention overcomes the disadvantages of the above described prior art illuminated switch assemblies by providing a unique layering of the membrane keypad assembly members to reduce the cost of manufacturing and increase the contrast and light output about the switch.

Generally, the invention provides an illuminated switch assembly having a switch layer on which conventional membrane or dome keypad switches are disposed and connected. The switch layer includes transparent regions located about the switch that, when illuminated, highlight and substantially surround the switch. A board, normally of the printed circuit variety, includes at least one light source for each switch. Appropriate cutout regions are located on the printed circuit board that are in registry with transparent regions of the switch layer. A reflector is operatively associated with the light source so that light from the light source is reflected off of the reflector and back through the transparent regions thereby visibly highlighting the switch and areas of the switch pad. Each of the light sources on the printed circuit board may be individually controlled from a source of electric current.

An advantage of the illuminated switch assembly of the present invention is that a low profile, high contrast switch assembly may be created in which each switch may be highlighted or selected. Additionally, the system permits an indication of the switch contact if the light source is connected in series with the switch and the power source.

Yet another advantage of the illuminated switch assembly of the present invention is that by using a maximum of two printed circuit boards, the expense to manufacture the system is minimized. Additionally, the use of conventional keypad technology utilizes the desirable resilience, wear and tactility available in membrane or dome keypads.

The invention, in one form thereof, provides an illuminated switch assembly comprising a membrane switch board including at least one switch associated therewith. The membrane switch board further includes a transparent region through which light may pass. A light source is mounted proximate or below the switch and a reflector is operatively associated with the light source so that light from the light source is reflected through the transparent region to illuminate the area around the switch.

In another aspect of the invention, the illuminated light switch assembly includes a membrane switch board having a first surface and second surface. A switch is mounted to the membrane switch board first surface ground which is located in a region through which light may pass. A printed circuit board having first and second surfaces includes a region through which light may pass and is positioned relative to the membrane switch board so that respective regions on each board are aligned. A light source is connected to the printed circuit board to which a reflector is operatively associated, so that the light from the light source is reflected through the regions.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
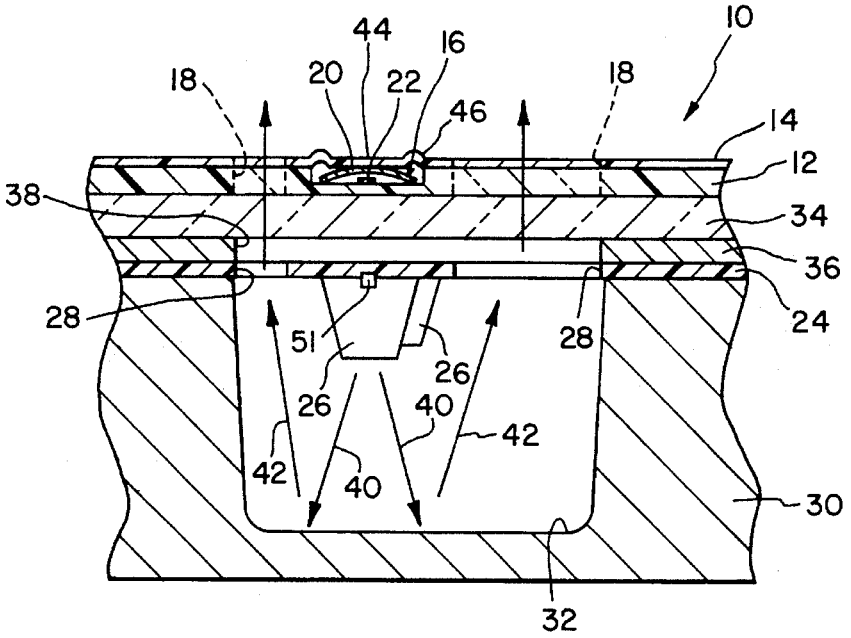
FIG. 1 is a sectional view of the illuminated switch assembly of the present invention.
Figure 2:
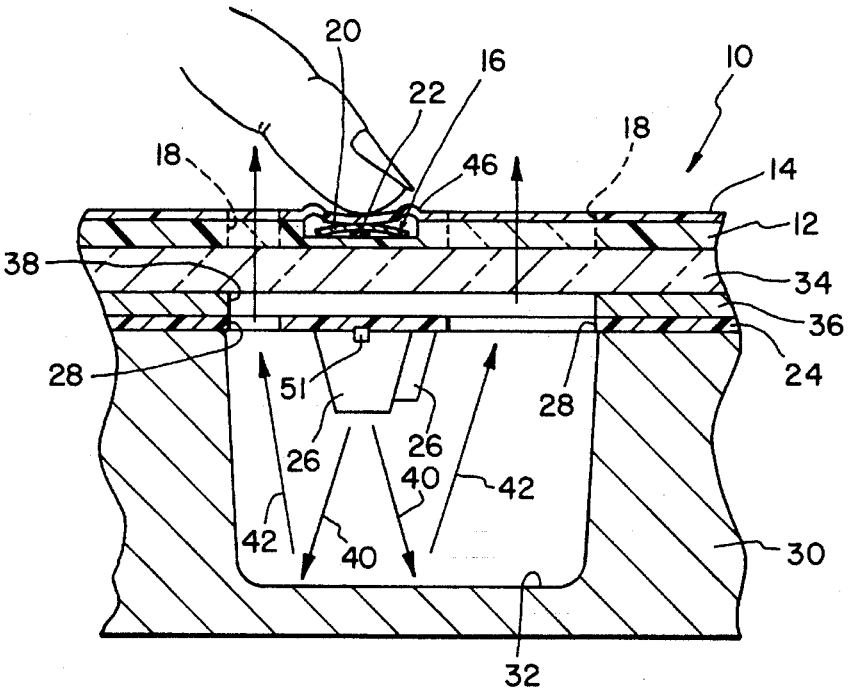
FIG. 2 is another section view of the illuminated switch assembly of the present invention shown with the switch actuated.

Referring now to the drawings and particularly to FIG. 1, there is shown an illuminated switch assembly 10 having a membrane switch board 12 provided with a plastic membrane cover 14. Plastic membrane cover 14 covers a switch matrix including a plurality of switches 16 of which one is shown in FIGS. 1 and 2. Membrane switch board 12 and plastic membrane cover 14 include transparent regions 18. Transparent regions 18 is comprised of colored or clear symbols, letters or numbers as indicia of the key function.

Additionally, transparent regions 18 may substantially surround switch 16 so that, when illuminated, create a substantial ring of light about switch 16.

Each switch 16 comprises a typical dome type momentary contact switch having an electrically conductive dome 20 and an electrical contact 22 disposed underneath. Pressure on dome 20 causes it to flex so that the center connects with the center electrical contact 22 thereby establishing electrical continuity between the two enclosing electrical circuits. Other types of switches such as micro switches or touch type switches may alternately be used. It is apparent to use known means to include the switch 16 as described herein in electrical circuits. One type of membrane switch board commercially available and adaptable for use is that of a membrane covered dome switch board from York, Pa.

In the simplest form of the invention, a printed circuit board 24 having a first surface and second surface is utilized. A a plurality of light sources 26 such as light emitting diodes (LED's) or incandescent bulbs are mounted proximate with or connected to the second surface of printed circuit board 24. Printed circuit board 24 further includes a plurality of through holes 28 thereby forming regions through which light may pass. Light sources 26 may include one or more LED's or incandescent lamps. In some cases, different colored LED's may be utilized to create and transmit different colors of light through transparent regions 18. Each light source 26 may be independently controlled via control lines extending sideways to a connector 52. Alternatively, transparent regions 18 within membrane switch board 12 may be tinted or colored. In an alternate form of the invention, the light source 26 may be attached beneath membrane switch board 12.

A reflector 30, having a reflective surface 32, is operatively associated with light sources 26. In the preferred form the invention, printed circuit board 24 and reflector 30 will be connected together with fasteners such as bolts and nuts. Reflector 30 is constructed from a milled piece of metal such as polished aluminum or steel, thereby creating reflective surfaces 32 which are formed in the bottom of a recess to surround or encircle light sources 26. When assembly 10 is assembled, holes 28 and transparent regions 18 are in alignment.

For additional support between the operative layers of switch assembly 10, there may be a clear plastic support 34 disposed between membrane switch board 12 and printed circuit board 24. Plastic support 34 may be made out of any clear plastic such as mylar or other equivalent plastic. For even more support, a metal plate, such as steel plate 36, may be disposed between membrane switch board 12 and printed circuit board 24 but preferably between clear plastic support 34 and printed circuit board 24. Metal plate 36 includes a plurality of openings 38 aligned with transparent regions 18 and holes 28 through which light may pass.

In operation, the illuminated switch assembly permits membrane or dome switch board 12 to be back lighted and turned on or off at will. As shown in FIGS. 1 and 2, light emitted from light sources 26, identified by arrows 40, are incident upon reflective surface 32 of reflector 30. Reflected light, as indicated by arrows 42, passes through holes 28 in printed circuit board 24, openings 38 of steel plate 36, plastic support 34, and through transparent regions 18 and out of switch assembly 10. Each light source 26 associated with switch 16 may be individually controlled via switch 16 or other circuitry. FIG. 2 shows an operator depressing conductive dome 20 into contact with electrical contact 22 thereby closing a circuit as is known in the art.

Figure 3:
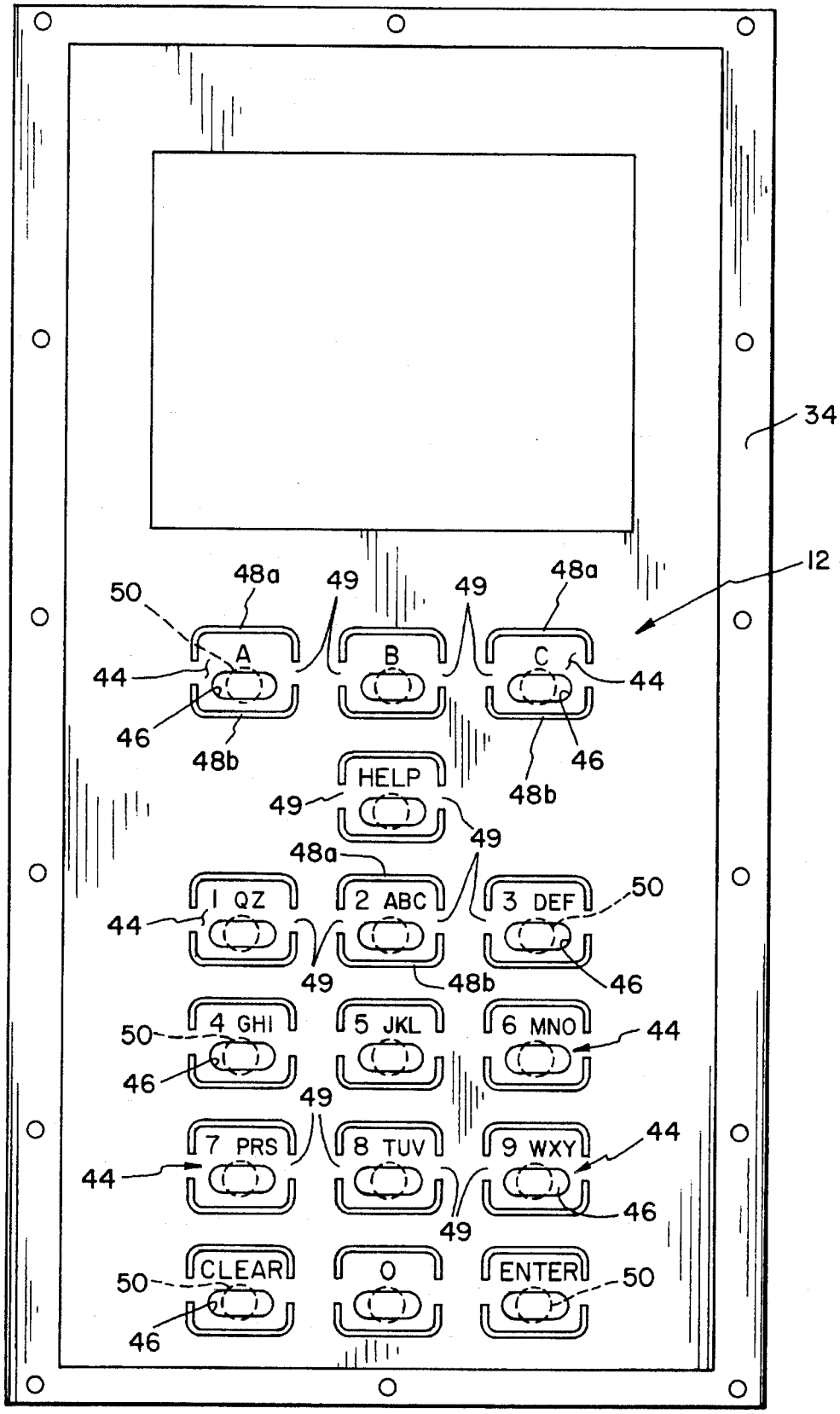
FIG. 3 is a fragmentary plan view of the illuminated switch assembly of the present invention.

In one embodiment of the invention, a plurality of switches 16 may be utilized on a membrane switch board 12. An exemplary switch area, as indicated by reference numeral 44, includes a contoured area 46 on plastic membrane cover 14 that creates a raised area to enable an operator to identify that a switch 16 is beneath area 46. As shown in FIG. 3, various types of transparent regions 18 may be utilized such as to depict letters, numerals or symbols. Additionally, transparent regions 18 may be utilized to create switch outlines or switch targets to assist the operator in selecting the proper switch 16. As shown in FIG. 3, each switch area 44 includes two bracketing transparent regions **48*a* and 48*b* but only a select few are numbered in the drawing. Areas 49 separating the bracketing regions 48*a* and 48*b* are located where the wires 51 or printed circuit layout may pass behind and be hidden from view. Each of these transparent bracket shaped areas permit a switch area 44 to be highlighted or illuminated. Dotted circle 50 indicates the location of switch 16 and beneath which is light source 26**.

Figure 4:
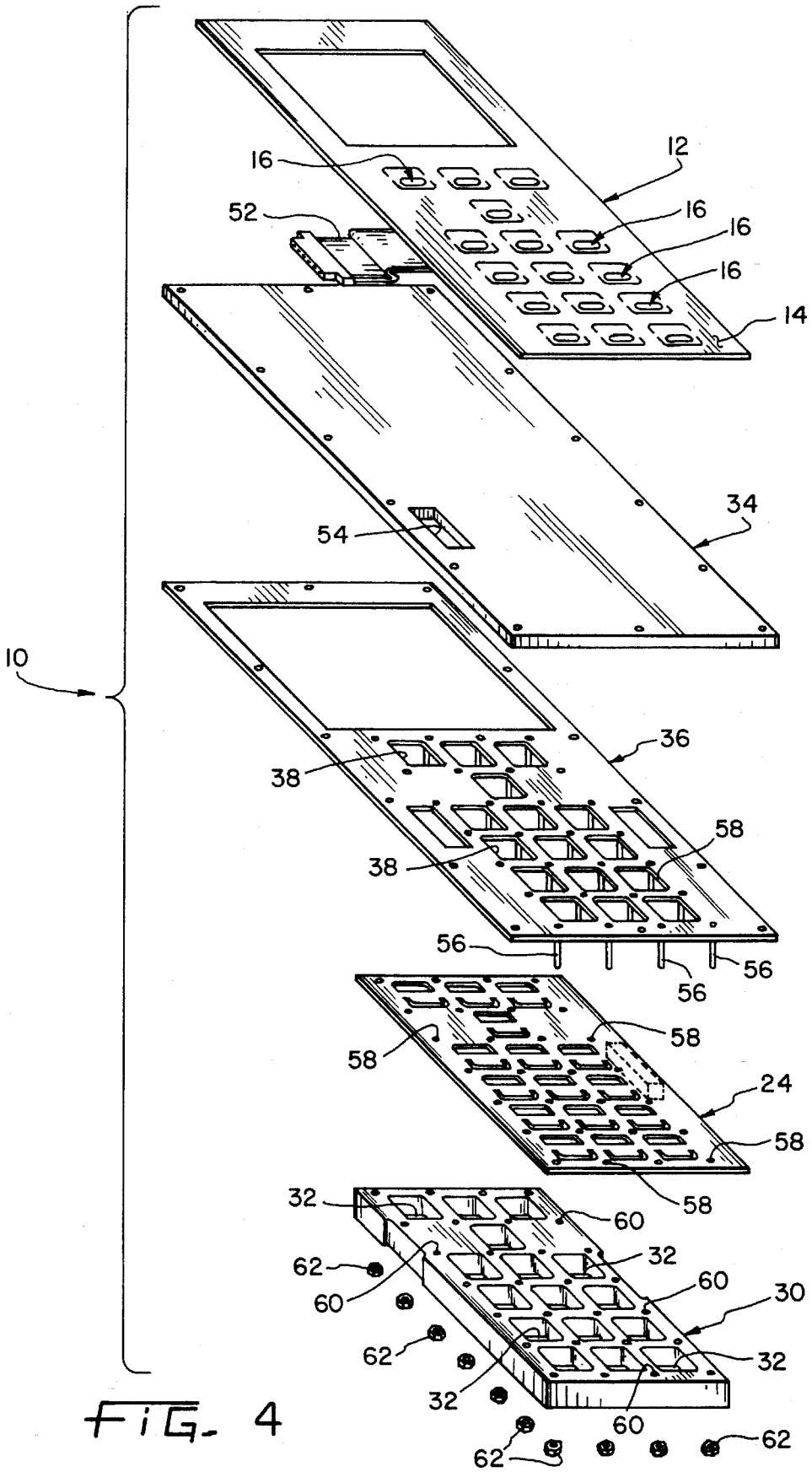
FIG. 4 is an exploded perspective view of the illuminated switch assembly of the present invention.

The embodiment of illuminated switch assembly 10 shown in FIGS. 1 and 2 may be constructed as shown in FIG. 4. Membrane switch board 12 having a plurality of switches 16 includes an electrical connector 52 to facilitate the carrying of electrical signals to and from other components to switches 16. Membrane switch board 12 may be attached as by gluing to clear plastic support 34. An opening 54 may be provided in clear plastic support for a passageway for electrical connector 52.

As shown in FIG. 4, a steel plate 36 includes a plurality of downward facing threaded studs 56 for attachment and location of printed circuit board 24 and reflector 30. Studs 56 are aligned through holes 58 in printed circuit board 24 and are further interfit into bores 60 through reflector 30. The amount of studs 56, holes 58 and bores 60 are sufficient in number to connect printed circuit board 24 including light sources 26 to reflector 30. A plurality of nuts 62 threadedly attach onto studs 56 thereby connecting steel plate 36, printed circuit board 24 and reflector 30 together. By combining membrane switch board 12 with a circuit board 24 having centrally located LED's 26 in parallel with switches 16, a very compact and easy to assembly switch assembly may be constructed.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An illuminated switch assembly comprising:

a membrane switch board including a switch mounted on an upper surface thereof and operatively associated therewith, said membrane switch board including a region through which light may pass;

a light source mounted adjacent a lower surface of said switch board and proximate said switch; and a reflector mounted adjacent said lower surface of said switch board and operatively associated with said light source, said reflector comprising a cavity wherein said light source is positioned within said cavity, said cavity defining a wall, said wall adapted to reflect light whereby light generated by said light source is directed away from said switch and into said cavity and thereafter reflected off said wall and through said region.

2. The switch assembly of claim 1 wherein said light source comprises a light emitting diode.

3. The switch assembly of claim 1 wherein said wall comprises polished aluminum.

4. The switch assembly of claim 1 wherein said assembly includes a plurality of switches and light sources, each light source independently controlled so that multiple light sources may be active at one time.

5. An illuminated switch assembly comprising:

a membrane switch board having a first surface and a second surface;

a switch mounted to said membrane switch board first surface, said switch board including a transparent region through which light may pass;

a circuit board having a first surface and a second surface, said circuit board having a region through which light may pass, said circuit board and said switch board positioned relative to each other so that respective said regions on said boards are aligned;

a light source connected to said circuit board; and a reflector operatively associated with said light source, said reflector comprising a cavity, said cavity defining a wall, said wall adapted to reflect light, whereby light generated by said light source is reflected through said respective regions of said boards.

6. The switch assembly of claim 5 wherein said light source comprises a light emitting diode.

7. The switch assembly of claim 5 wherein said wall comprises polished aluminum.

8. The switch assembly of claim 5 wherein said assembly includes a plurality of switches and light sources, each light source independently controlled so that multiple light sources may be active at one time.

9. The switch assembly of claim 5 wherein said transparent region substantially surrounds said switch.

* * * * *